US009685029B2

(12) United States Patent
Erickson et al.

(10) Patent No.: US 9,685,029 B2
(45) Date of Patent: Jun. 20, 2017

(54) ACTUATING GAMING MACHINE CHAIR

(75) Inventors: Eric V. Erickson, Mt Prospect, IL (US); Timothy T. Gronkowski, Chicago, IL (US); Joel R. Jaffe, Glenview, IL (US); Paul M. Lesley, Blue Island, IL (US); Scott A. Massing, Lincolnwood, IL (US); Alfred Thomas, Las Vegas, NV (US)

(73) Assignee: BALLY GAMING, INC., Las Vegas, NV (US)

( * ) Notice: Subject to any disclaimer, the term of this patent is extended or adjusted under 35 U.S.C. 154(b) by 743 days.

(21) Appl. No.: 13/509,617

(22) PCT Filed: Nov. 12, 2010

(86) PCT No.: PCT/US2010/056625

§ 371 (c)(1),
(2), (4) Date: May 14, 2012

(87) PCT Pub. No.: WO2011/060331

PCT Pub. Date: May 19, 2011

(65) Prior Publication Data

US 2013/0005442 A1 Jan. 3, 2013

(51) Int. Cl.
*A63F 9/24* (2006.01)
*G07F 17/32* (2006.01)

(52) U.S. Cl.
CPC ..... *G07F 17/32* (2013.01); *G07F 17/3216* (2013.01)

(58) Field of Classification Search
CPC ..... G07F 17/32; G07F 17/3216
(Continued)

(56) References Cited

U.S. PATENT DOCUMENTS 6,026,920 A * 2/2000 Obeda et al. ..... 180/41
2007/0060229 A1* 3/2007 Okada et al. ..... 463/1
(Continued)

FOREIGN PATENT DOCUMENTS

EP 1306051 3/2005
GB 2406504 4/2005
WO WO-2011060331 5/2011

OTHER PUBLICATIONS

"PCT Application No. PCT/US10/56625 International Preliminary Report on Patentability", Jan. 25, 2012 , 13 pages.
(Continued)

*Primary Examiner* — David L Lewis
*Assistant Examiner* — Robert Mosser
(74) *Attorney, Agent, or Firm* — DeLizio Law, PLLC

(57) ABSTRACT

Wagering game systems including gaming chairs are described herein. In some embodiments, a method includes receiving, in a wagering game machine, access information identifying a wagering game player, and determining the wagering game players motion profile associated with a gaming chair connected to the wagering game machine, wherein the motion profile indicates movements of the gaming chair that are acceptable to the wagering game player. The method also includes determining prescribed motions for the gaming chair, wherein the prescribed motions are associated with wagering game events, and determining that one of the wagering game events occurred on the wagering game machine. The method also includes moving the gaming chair in accordance with the prescribed motions for the gaming chair and the wagering game players motion profile.

10 Claims, 9 Drawing Sheets

(58) Field of Classification Search
USPC ..... 463/1, 16, 30, 47
See application file for complete search history.

(56) References Cited

U.S. PATENT DOCUMENTS

| | | | |
|---|---|---|---|
| 2008/0054561 | A1 | 3/2008 | Canterbury et al. |
| 2008/0111408 | A1 | 5/2008 | Duran et al. |
| 2009/0143141 | A1 | 6/2009 | Wells et al. |

OTHER PUBLICATIONS

"PCT Application No. PCT/US10/56625 International Search Report", Jan. 31, 2011 , 11 pages.

* cited by examiner

ACTUATING GAMING MACHINE CHAIR

RELATED APPLICATIONS

This application claims the priority benefit of U.S. Provisional Application Ser. No. 61/261,307 filed Nov. 14, 2009.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2010, WMS Gaming, Inc.

FIELD

Embodiments of the inventive subject matter relate generally to wagering game systems, and more particularly to wagering game systems including actuating gaming chairs.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Some have attempted to enrich gaming experiences by providing wagering game machines that have motion-capable chairs.

SUMMARY

In some embodiments, a method comprises receiving, in a wagering game machine, access information identifying a wagering game player; determining the wagering game player's motion profile associated with a gaming chair connected to the wagering game machine, wherein the motion profile indicates movements of the gaming chair that are acceptable to the wagering game player; determining prescribed motions for the gaming chair, wherein the prescribed motions are associated with wagering game events; determining that one of the wagering game events occurred on the wagering game machine; moving the gaming chair in accordance with the prescribed motions for the gaming chair and the wagering game player's motion profile.

In some embodiments, the prescribed motions of the gaming chair include one or more of a vibration motion, a pitch motion, a roll motion, a heave motion, a tilt motion, and a rotational motion.

In some embodiments, the method further comprises determining that another of the wagering game events occurred at another wagering game machine; moving, in response to the other of the wagering game events, the gaming chair in accordance with the prescribed chair movements and the wagering game player's motion profile.

In some embodiments, the method further comprises notifying another wagering game player about the one of the wagering game events, wherein the notifying includes, determining another gaming chair in which the other player is sitting; and moving the other gaming chair.

In some embodiments, the method further comprises determining a center of gravity of the wagering game player; and reconfiguring the prescribed motions based on the center of gravity of the wagering game player.

In some embodiments, a method comprises presenting wagering game content on a wagering game machine; detecting player-induced motion of a gaming chair connected to the wagering game machine, wherein the detecting includes receiving sensor information from sensors in the gaming chair; analyzing the sensor information to determine a direction of the player-induced motion; changing, based on the direction of the player-induced motion, a viewing perspective of the wagering game content; and moving the gaming chair in another direction in response to the player-induced motion.

In some embodiments, the method further comprises determining movements for the gaming chair for each of a group of wagering game events; modifying the movements based on the player-induced motion of the gaming chair.

In some embodiments, the analyzing further includes determining a force of the player-induced motion, and a periodicity of the player-induced motion.

In some embodiments, the method further comprises determining a motion profile associated with the gaming chair and a wagering game player, wherein the motion profile indicates movements of the gaming chair that are acceptable to the wagering game player, and wherein the moving the gaming chair in another direction is performed in accordance with the motion profile.

In some embodiments, the player-induced motion occurs during a wagering game being presented on the wagering game machine and other wagering game machines, and wherein the method further comprises moving, in response to the player-induced motion, other gaming chairs that are connected to the other wagering game machines.

In some embodiments, a system comprises a wagering game machine configured to present wagering games; a gaming chair connected to the wagering game machine, wherein the gaming chair includes actuators configured to move the gaming chair in different directions and orientations; sensors configured to detect player-induced movements of the gaming chair; a chair motion management unit configured to determine motions for the gaming chair based on game events and player input indicating desired motions of the gaming chair; detect the wagering game events; request, in response to the wagering game events, movement of the gaming chair, wherein the movement of the gaming chair is in accordance with the player input and with prescribed chair motions associated with the wagering game events; and a motion database including the prescribed chair motions, wherein the motion database is accessible to the chair motion management unit.

In some embodiments, the system further comprises a motion controller connected to the gaming chair and the chair motion management unit, the motion controller configured to activate the actuators in response to the request for movement of the gaming chair.

In some embodiments, the game events include one or more of winning a given amount of money, losing a given amount of money, playing for a specified period of time, and winning a tournament.

In some embodiments, the movement of the gaming chair includes one or more of tilting the gaming chair, rotating the gaming chair, raising the gaming chair, and lowering the gaming chair.

In some embodiments, the chair motion management unit is further configured to determine, based on information detected by the sensors, a center of gravity of a player sitting in the gaming chair; and modify the prescribed chair motions based on the center of gravity of the player.

In some embodiments, a tangible machine-readable medium including instructions, which when executed by a machine, cause the machine to perform operations comprising presenting a wagering game on a wagering game machine, wherein a gaming chair is connected to the wagering game machine; determining a group of motions for the gaming chair based on player input and prescribed motions associated game events; calculating a center of gravity of a wagering game player in the gaming chair; comparing the center of gravity of the player with a center of gravity of the gaming chair and boundaries of the gaming chair; determining that the motions for the gaming chair are unsafe for the wagering game player based on the comparing of the center of gravity of the player with the center of gravity of the gaming chair and the boundaries of the gaming chair; altering the group of motions to include motions that are safe for the wagering game player; and causing the gaming chair to move according to the motions that are safe for the wagering game player.

In some embodiments, the player input indicates motions for the gaming chair that are preferable to the wagering game player.

In some embodiments, the motions include one or more of tilting the gaming chair, rotating the gaming chair, raising the gaming chair, and lowering the gaming chair.

In some embodiments, an apparatus comprises means for receiving, in a wagering game machine, access information identifying a wagering game player; means for determining the wagering game player's motion profile associated with a gaming chair connected to the wagering game machine, wherein the motion profile indicates movements of the gaming chair that are acceptable to the wagering game player; means for determining prescribed motions for the gaming chair, wherein the prescribed movements are associated with wagering game events; means for determining that one of the wagering game events occurred on the wagering game machine; means for moving the gaming chair in accordance with the prescribed chair movements and the wagering game player's motion profile.

In some embodiments, the prescribed motions of the gaming chair include one or more of a vibration motion, a pitch motion, a roll motion, a heave motion, a tilt motion, and a rotational motion.

In some embodiments, the apparatus further comprises means for determining that another of the wagering game events occurred at another wagering game machine; means for moving, in response to the other of the wagering game events, the gaming chair in accordance with the prescribed chair movements and the wagering game player's motion profile.

In some embodiments, the method further comprises notifying another wagering game player about the one of the wagering game events, wherein the notifying includes, determining another gaming chair in which the other player is sitting; and moving the other gaming chair.

In some embodiments, the apparatus further comprises means for determining a center of gravity of the wagering game player; and means for reconfiguring the prescribed motions based on the center of gravity of the wagering game player.

BRIEF DESCRIPTION OF THE FIGURES

Embodiments of the invention are illustrated in the Figures of the accompanying drawings in which.

DESCRIPTION OF THE EMBODIMENTS

This description of the embodiments is divided into four sections. The first section provides an introduction to embodiments of the invention, while the second section example wagering game machine networks and wagering game machine architectures. The third section describes presents operations performed by some embodiments. The fourth section some general comments.

Introduction

This section provides an introduction to some embodiments of the invention.

Some gaming chairs move based on audio and video content, such as content presented on video game screens and speakers, theatre screens and speakers, etc. The audio and video content may comprise audio/visual cues or motion signals embedded in the content. The gaming chairs may be configured to recognize and interpret these audio/visual cues and move accordingly, synchronizing chair motion with the audio and video content. For example, a gaming chair may vibrate in response to content showing a car starting its engine, or the gaming chair may move backwards to produce a sensation of the car accelerating. However, gaming chair motion are not typically associated with players' moods and are not related to player movements, motion of other objects/ players, casino events, etc. Furthermore, gaming chairs do not typically move based on player preferences, player status in games, etc.

Some embodiments of the inventive subject matter facilitate controlling gaming chair movements in accordance with wagering game content, wagering game events, anticipatory events, events celebrating other players' victories, and more. Some embodiments include a motion controller that controls chair motion in accordance with chair motions relating to game events and other wagering game aspects. In some instances, players can customize their own chair movements. By allowing players to customize the chair movements, players can control and induce chair motion based on their preferences. The motion controller may also allow synchronization of motion across multiple gaming chairs. In some embodiments, the motion controller dynamically reconfigures chair movements according to external effects, such as motion of adjacent chairs, motion of the player in the chair, motion of people near the chair, etc.

Figure 1:
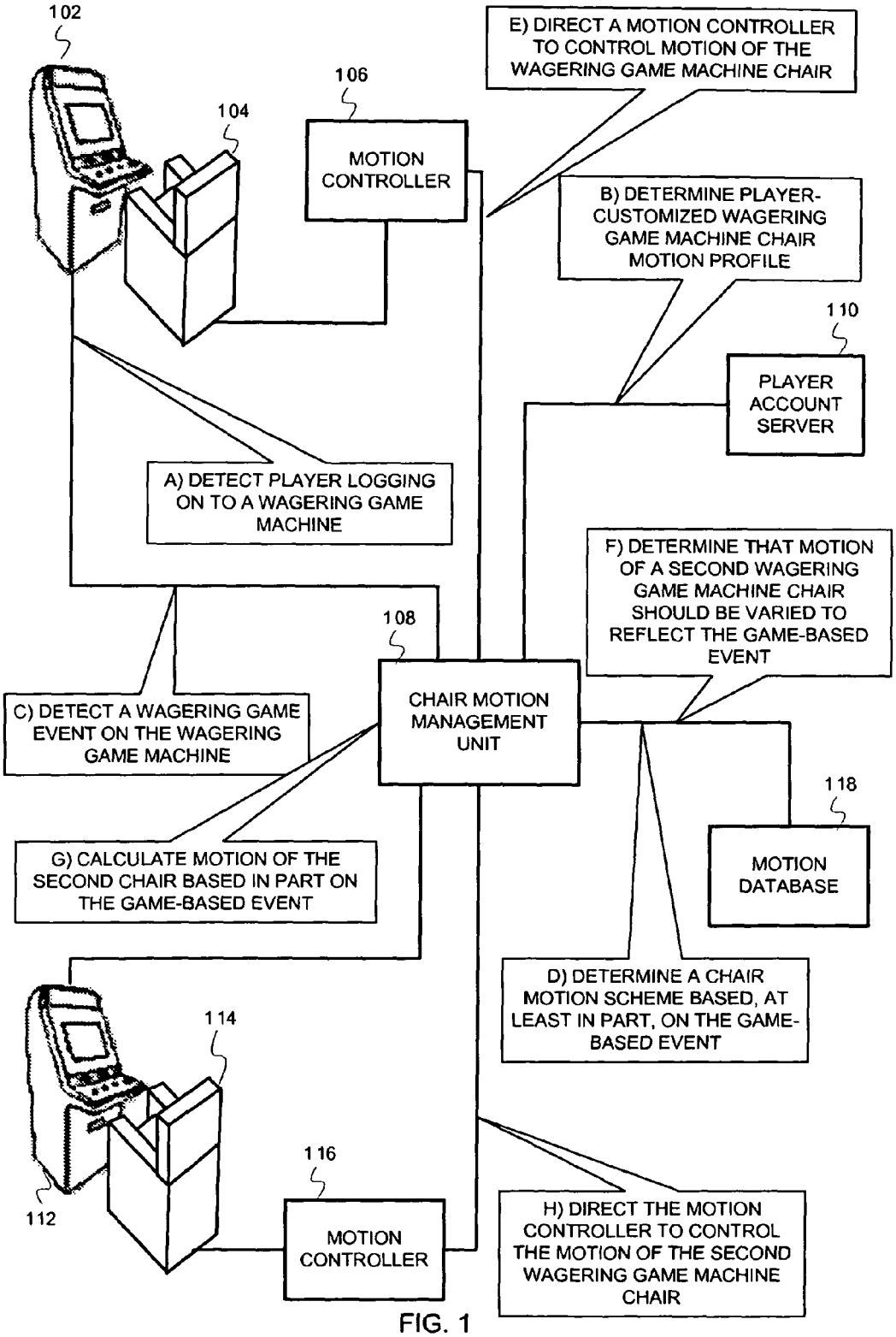
FIG. 1 is an example conceptual diagram illustrating controlling motion of a gaming chair.

FIG. 1 is an example conceptual diagram illustrating controlling motion of a gaming chair. FIG. 1 depicts a chair motion management unit 108, a player account server 110, a motion database 118, and motion controllers 106 and 116. FIG. 1 also depicts wagering game machines 102 and 112 connected with gaming chairs 104 and 114. The motion controllers 106 and 116 control motion of the gaming chairs 104 and 114, respectively. The chair motion management unit 108 can communicate with the player account server 110 and the motion database 118 to determine motions for the gaming chairs 104 and 114. The chair motion management unit 108 can direct the motion controllers 106 and 116 to vary chair movements, as will be described below in stages A-H.

At stage A, the chair motion management unit 108 detects a player logging on to the wagering game machine 102. In one embodiment, a wagering game server (not shown) may detect the player logging on to the wagering game machine 102 and notify the chair motion management unit 108. The wagering game server can receive the player's login information, which may include a biometric identifier (e.g., a fingerprint, input from a retina scan, etc.), a set of alphanumeric characters, information retrieved from a swipe card, a voice sample, etc. The wagering game server can compare the player's login information against player information in the player account server 110, and accordingly validate or reject the player's login attempt. After the wagering game server validates the player, the player gains access to the wagering game machine 102.

At stage B, the chair motion management unit 108 determines a player-customized gaming chair motion profile ("chair motion profile"). The chair motion management unit 108 can receive the player-customized chair motion profile from the player account server 110. The chair motion profile can indicate a player's preferences for the gaming chair. The chair motion profile can indicate a set of chair motions acceptable to the player, and player preferred motion intensities, frequencies, and forces. For example, the player-customized chair motion profile may indicate that the chair motion management unit 108 should not rotate the gaming chair 104. As another example, the player-customized chair motion profile may indicate that the chair motion management unit 108 should vibrate the gaming chair 104 to indicate certain losing events (e.g., the player losing $5), and heave the gaming chair 104 to indicate certain winning events (e.g., the player winning a wagering game tournament). If the chair motion management unit 108 is unable to identify a player-customized chair motion profile, the chair motion management unit 108 may select a default chair motion profile, prompt the player to input preferences, or prompt the player to select a preconfigured chair motion profile.

At stage C, the chair motion management unit 108 detects a wagering game event (e.g., base game results, bonus game results, etc.). In some embodiments, the wagering game server (not shown) controls wagering game outcomes, so it may detect the wagering game event and communicate the event to the chair motion management unit 108. In another embodiment, the wagering game machine 102 may itself detect and communicate the event to the chair motion management unit 108. In other embodiments, the chair motion management unit 108 may monitor the wagering game machine's activities and operations to identify the wagering game event.

At stage D, the chair motion management unit 108 determines chair movements based on the wagering game event. The chair motion management unit 108 may access the motion database 118 to determine movements for the gaming chair 104. The motion database 118 includes a set of chair motions associated with different events, such as wagering game events and game outcomes. The chair motions can increase excitement and anticipation about current and prospective wagering game events. The set of chair motions can include one or more vibration motions, pitch motions, roll motions, heave motions, tilt motions, rotational motions, and linear motions. For example, the chair motion management unit 108 may access the motion database 118 and determine that for a wagering game event in which a player's winnings exceeds $100, the player's gaming chair 104 should vibrate at high intensity for 10 seconds. As another example, the chair motion management unit 108 may determine, based on information in the motion database 118, that when a player's losses exceed $10, the player's gaming chair 104 vibrates at a frequency of 20 Hz for 5 seconds. As another example, the chair motion management unit 108 may determine the gaming chair 104 should rotate 20 degrees left and right when a payback percentage exceeds a first threshold, rotate 50 degrees left and right when the payback percentage exceeds a second threshold, and rotate by 360 degrees when the payback percentage exceeds a third threshold.

As noted in the discussion of stage B, the chair motion management unit 108 may access a player-customized chair motion profile in the player account server 110. In some instances, the player-customized profile may conflict with chair movements prescribed by the motion database 118. For example, the motion data may call for chair rotation for a given event, whereas the player-customized chair motion profile indicates that the player does not want the gaming chair to rotate. The chair motion management unit 108 can resolve conflicts by substituting acceptable motions and/or omitting undesirable chair motions.

At stage E, the chair motion management unit 108 directs the motion controller 106 to move the gaming chair 104 according to the motion determined at stage D. The gaming chair 104 may comprise one or more actuators that move gaming chair 104 in various directions and orientations. The chair motion management unit 108 may direct the motion controller 106 to activate the actuators, moving the gaming chair 104. For example, the chair motion management unit 108 may direct the motion controller 106 to activate a specific actuator to tilt the gaming chair 104 to its left.

At stage F, the chair motion management unit 108 determines that another gaming chair (e.g., gaming chair 114) should also move to reflect the wagering game event. In one embodiment, the player at the wagering game machine 102 indicates other players to whom the event should be communicated via chair movements. The player may identify the other players by specifying player identifiers (e.g., player names, gaming identifiers, etc.). After detecting the wagering game event, the chair motion management unit 108 can direct the wagering game server to determine gaming chairs in which the other players are sitting (e.g., based on login information indicating wagering game machines at which the players are playing).

In some embodiments, the chair motion management unit 108 can coordinate movements across a bank of gaming chairs on a common motion platform. Gaming chair movements can also be coordinated for players playing competitive games, network-based games, multi-player games, etc.

At stage G, the chair motion management unit 108 determines movements for the gaming chair 114 based, at least in part, on the wagering game event. The chair motion management unit 108 can replicate movements of the gaming chair 104 on the gaming chair 114. Alternatively, the management unit 108 can look-up chair movements in the motion database 118. Also, the management unit 108 may access the player account server 110 and determine a chair motion profile customized by the player sitting in the chair 114.

At stage H, the chair motion management unit 108 directs the motion controller 116 to move the gaming chair 114 based on movements determined at stage G. As described earlier, the chair motion management unit 108 may direct the motion controller 116 to activate one or more actuators of the gaming chair 114 to control movements of the gaming chair 114.

In a multi-player competitive gaming scenario, variations in chair motions may be used to indicate various stages of the wagering game. For example, the motion controller 116 may vibrate the gaming chair 114 to indicate that the player in the gaming chair 114 has passed another player (e.g., achieved a higher rank, accumulated more points, etc.). As another example, the motion controller 116 may rock the gaming chair 114 from side to side to indicate that another player has passed the player in the gaming chair 114. As another example, the motion controller 116 may tilt the chair 114 forward to indicate that the player has overtaken another player.

It should be noted that in some embodiments, the motion controllers 106 and 116 might be embodied as part of the chair motion management unit 108. In some embodiments, the chair motion management unit 108 and the motion controllers 106 and 116 may be implemented on a common electronic module (e.g., an integrated circuit), and may include software and other components for carrying-out the functionality described herein. In other embodiments, the chair motion management unit 108 may control motion of the gaming chairs 104 and 114 without intermediary motion controllers 106 and 116.

Although FIG. 1 describes some embodiments, the following sections describe many other features and embodiments.

Operating Environment

This section describes an example operating environment and presents structural aspects of some embodiments. This section includes discussion about wagering game networks and wagering game machine architectures.

Wagering Game Networks

Figure 2:
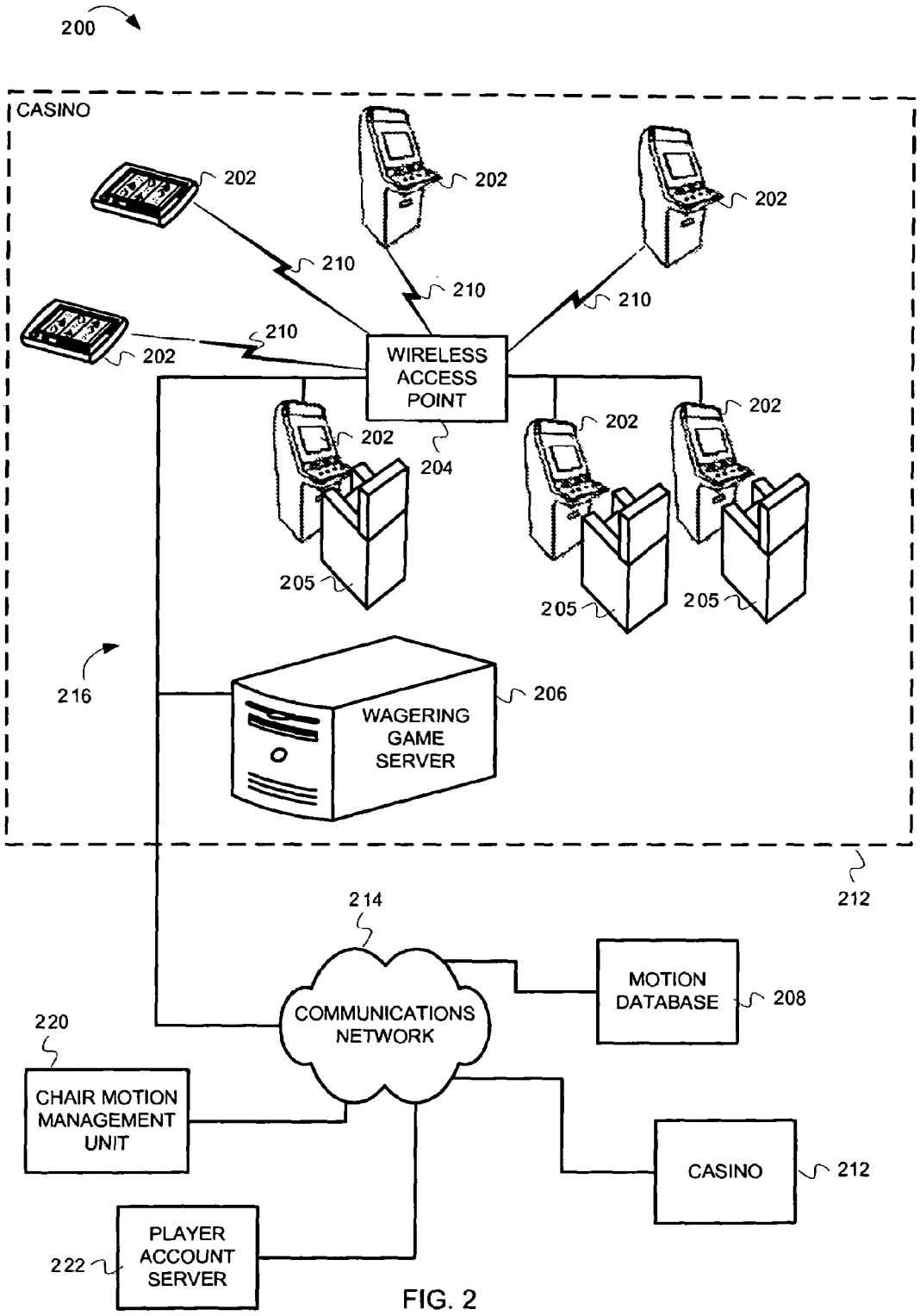
FIG. 2 is a block diagram illustrating a wagering game network 200, according to example embodiments of the invention.

FIG. 2 is a block diagram illustrating a wagering game network 200, according to example embodiments of the invention. As shown in FIG. 2, the wagering game network 200 includes a plurality of casinos 212 connected to a communications network 214. The casinos 212 are connected, via the communications network 214, to a player account server 222, motion database 208, and chair motion management unit 220.

Each casino 212 includes a local area network 216, which includes an access point 204, wagering game server 206, and wagering game machines 202. The access point 204 provides wireless communication links 210 and wired communication links 208. The wired and wireless communication links can employ any suitable connection technology, such as Bluetooth, 802.11, Ethernet, public switched telephone networks, SONET, etc.

The wagering game server 206 can serve wagering games, distribute content to devices located in other casinos 212 or at other locations on the communications network 214, authenticate players, etc.

The player account server 222 stores information identifying players, such as biometric information, player name and identification number, voice and handwriting characteristics (e.g., for voice and signature recognition respectively), etc. The player account server 222 can also include player-customized chair motion preferences, and other player information. The player account server 222 can also indicate other players that should be notified of wagering game events. In some instances, the wagering game server 206 may determine (e.g., using login information and device identifiers) which gaming chairs the other players are occupying, and communicate such information to chair motion management unit 220.

The motion database 208 can store chair movements for particular wagering game events. In some embodiments, there are configuration tools that enable drag-and-drop association of chair movements to various events and information, such as wagering game events, themes, chair locations, casino locations, etc. The motion database 208 can store such prescribed chair movements and events that trigger them.

The chair motion management unit 220 controls motion of the gaming chairs 205 based on wagering game events. The chair motion management unit 220 can determine chair movements for gaming chairs associated with the wagering game machines 202. The chair movements can indicate wagering game events occurring on the wagering game machines 202. The chair motion management unit 220 may determine chair movements, an intensity of the chair movements, a periodicity of the chair movements, a frequency of the chair movements, a velocity of the movements etc. The chair motion management unit 220 may also determine the chair movements based on the player-customized chair motion preferences. The chair motion management unit 220 may also determine chair movements for notifying other players of wagering game events or synchronizing motion across multiple gaming chairs.

In some embodiments, the chair motion management unit 220 can monitor players comfort level with chair motions. In determining comfort level with the gaming chairs 205, the management unit 220 can monitor player's betting frequencies, and other playing tendencies. Also, sensors in the chair 205 can indicate how players are positioned in the chairs, how often they reposition in the chairs, etc. The chair motion management unit 220 can analyze the sensor data to determine whether players are uncomfortable, restless, etc. If the management unit 220 determines a player is uncomfortable, it can automatically cancel or change motion behavior of the gaming chairs 205. The monitoring and analysis can include betting frequency analysis, biometric monitoring (e.g. cardio monitoring), facial gesture recognition, etc.

The gaming chairs 205 can raise, lower, vibrate, tilt, rotate, and otherwise move in any suitable direction and orientation. The gaming chair 205 can include independent actuators, actuators connected to a common pivot, and other actuator configurations. The chairs 205 can also include motors, servos, and other components that facilitate movement. In some embodiments, the chairs 205 include a motion stop mechanism, such as a button or switch that can immediately stop chair motion. In some embodiments, the motion stop mechanism can reside on the wagering game machine 202.

The wagering game machines 202 described herein can take any suitable form, such as floor standing models, handheld mobile units, bar-top models, workstation-type console models, etc. Further, the wagering game machines 202 can be primarily dedicated for use in conducting wagering games, or can include non-dedicated devices, such as mobile phones, personal digital assistants, personal computers, etc. In one embodiment, the wagering game network 200 can include other network devices, such as accounting servers, wide area progressive servers, player-tracking servers, and/or other devices suitable for use in connection with embodiments of the invention.

In some embodiments, wagering game machines 202 and wagering game servers 206 work together such that a wagering game machine 202 can be operated as a thin, thick, or intermediate client. For example, one or more elements of game play may be controlled by the wagering game machine 202 (client) or the wagering game server 206 (server). Game play elements can include executable game code, lookup tables, configuration files, game outcome, audio or visual representations of the game, game assets, or the like. In a thin-client example, the wagering game server 206 can perform functions such as determining game outcome or managing assets, while the wagering game machine 202 can present a graphical representation of such outcome or asset modification to the user (e.g., player). In a thick-client example, the wagering game machines 202 can determine game outcomes and communicate the outcomes to the wagering game server 206 for recording or managing a player's account.

In some embodiments, either the wagering game machines 202 (client) or the wagering game server 206 can provide functionality that is not directly related to game play. For example, account transactions and account rules may be managed centrally (e.g., by the wagering game server 206) or locally (e.g., by the wagering game machine 202). Other functionality not directly related to game play may include power management, presentation of advertising, software or firmware updates, system quality or security checks, etc.

Any of the wagering game network components (e.g., the wagering game machines 202) can include hardware and machine-readable media including instructions for performing the operations described herein. The following section describes architecture of the wagering game machine.

Wagering Game Machine Architectures

Figure 3:
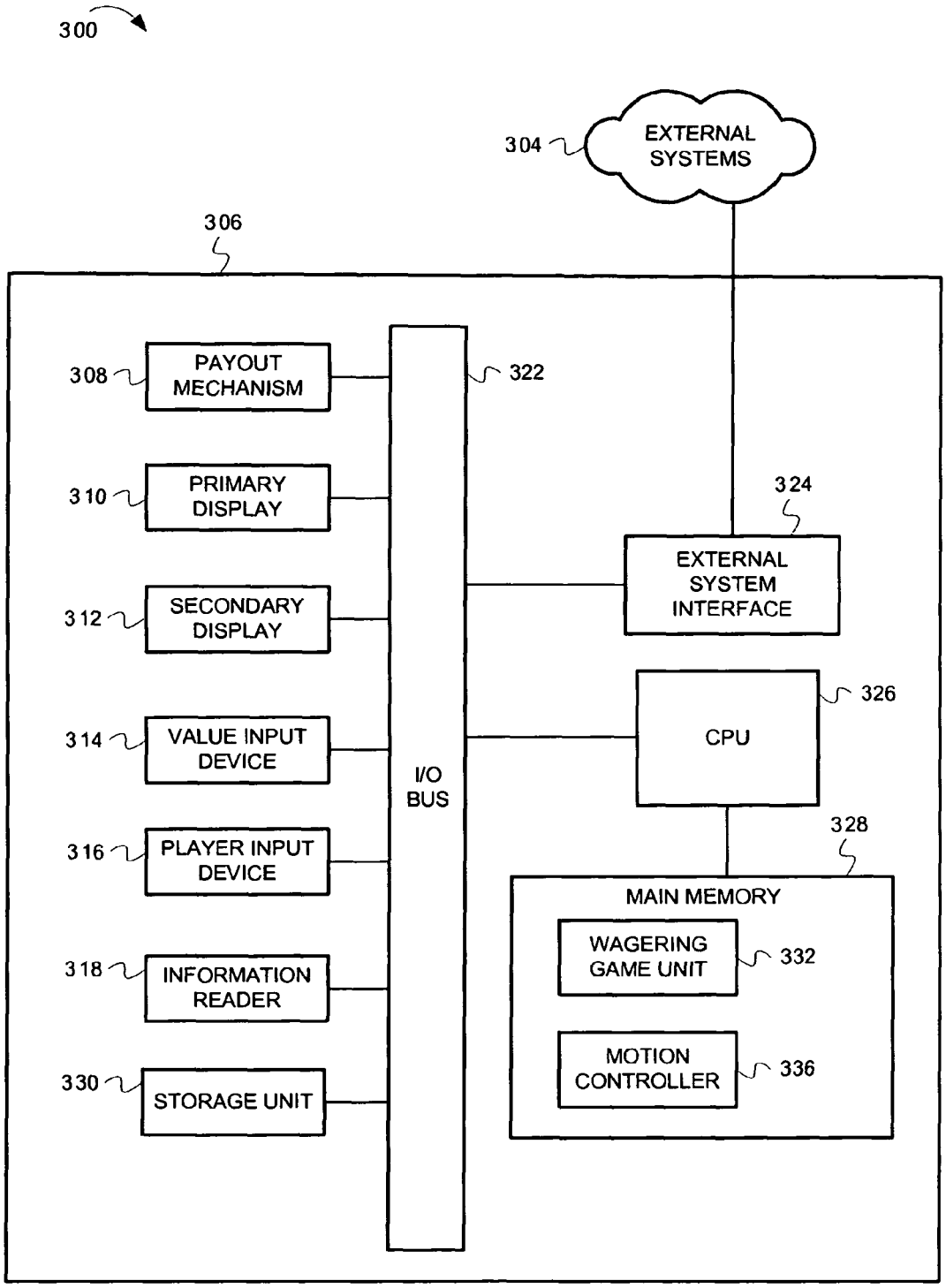
FIG. 3 is a block diagram illustrating wagering game machine architecture, according to example embodiments of the invention.

FIG. 3 is a block diagram illustrating wagering game machine architecture, according to example embodiments of the invention. As shown in FIG. 3, the wagering game machine architecture 300 includes a wagering game machine 306, which includes a central processing unit (CPU) 326 connected to main memory 328. The CPU 326 can include any suitable processor, such as an Intel® Pentium processor, Intel® Core 2 Duo processor, AMD Opteron™ processor, or UltraSPARC processor. The main memory 328 comprises a wagering game unit 332 and a motion controller 336. In one embodiment, the wagering game unit 332 can present wagering games, such as video poker, video black jack, video slots, video lottery, etc., in whole or part.

The motion controller 336 can facilitate gaming chair movements, determine player-customized chair motion preferences, etc. However, the motion controller need not reside in the wagering game machine. The motion controller and functionality for moving the gaming chairs may be implemented within the wagering game machine, within the gaming chair, in a separate device (e.g., a server), etc. In some embodiments, the motion controller 336 may receive instructions from a server or other component and vary the motion of the gaming chair in accordance with those instructions.

The CPU 326 is also connected to an input/output (I/O) bus 322, which can include any suitable bus technologies, such as an AGTL+ frontside bus and a PCI backside bus. The I/O bus 322 is connected to a payout mechanism 308, primary display 310, secondary display 312, value input device 314, player input device 316, information reader 318, and storage unit 330. The player input device 316 can include the value input device 314 to the extent the player input device 316 is used to place wagers. The I/O bus 322 is also connected to an external system interface 324, which is connected to external systems 304 (e.g., wagering game networks).

In one embodiment, the wagering game machine 306 can include additional peripheral devices and/or more than one of each component shown in FIG. 3. For example, in one embodiment, the wagering game machine 306 can include multiple external system interfaces 324 and/or multiple CPUs 326. In one embodiment, any of the components can be integrated or subdivided.

Any component of the architecture 300 can include hardware, firmware, and/or machine-readable media including instructions for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc.

Example Operations

This section describes operations associated with some embodiments of the invention. In the discussion below, the flow diagrams will be described with reference to the block diagrams presented above. However, in some embodiments, the operations can be performed by components not described in the block diagrams.

In certain embodiments, the operations can be performed by executing instructions residing on machine-readable media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments may perform less than all the operations shown in any flow diagram. This section will discuss FIGS. 4-8.

Figure 4:
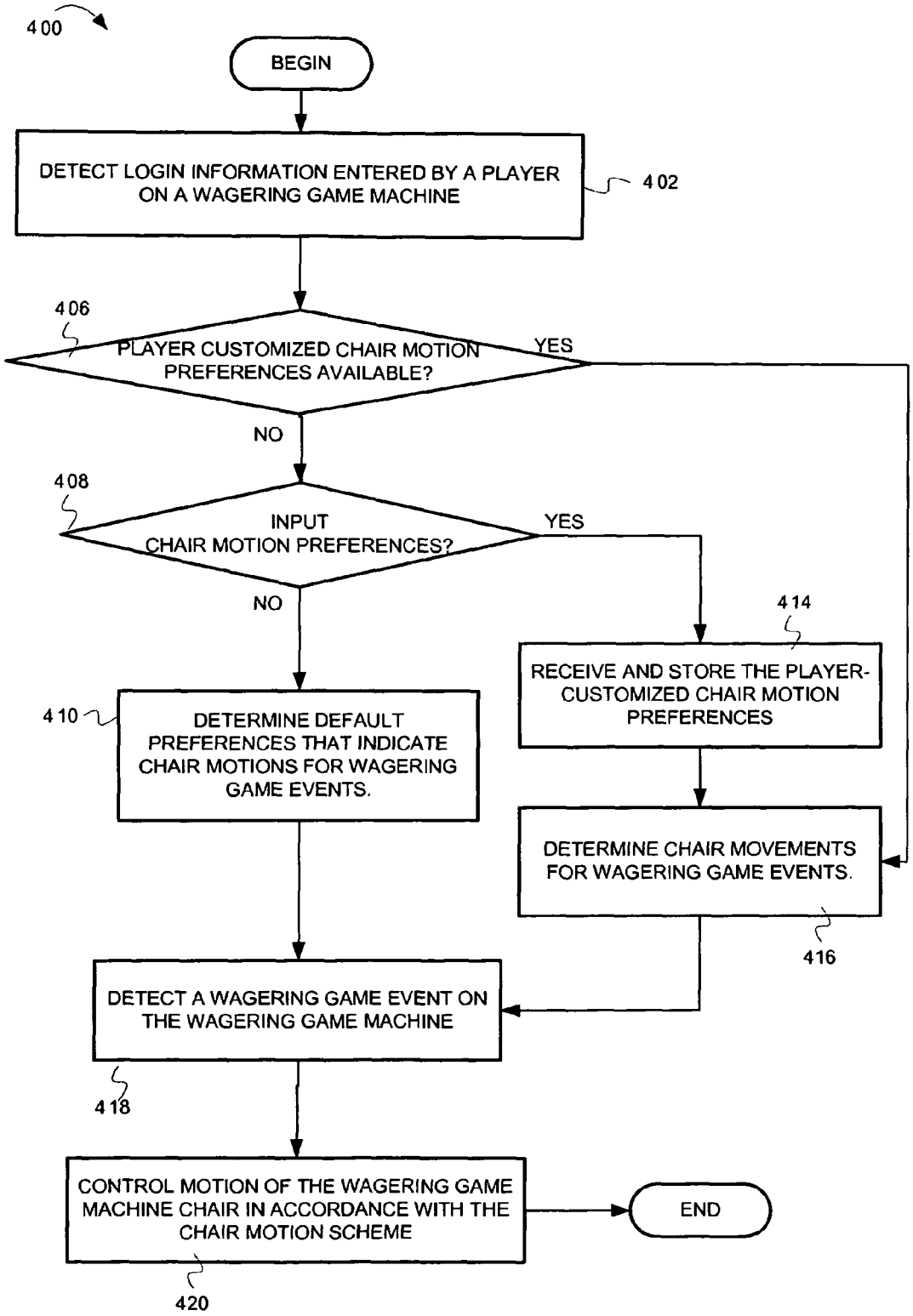
FIG. 4 is a flow diagram illustrating operations for customizing motion of a gaming chair, according to some embodiments of the invention.

FIG. 4 is a flow diagram illustrating operations for customizing motion of a gaming chair, according to some embodiments of the invention. Flow 400 will be described with reference to the block diagram of FIG. 2. The flow 400 begins at block 402.

At block 402, the player account server 222 detects login information entered by a player at a wagering game machine 202. The login information may comprise biometric information (e.g., from a fingerprint scanner, from a retina scanner, etc.), information from a swipe card, a set of alphanumeric characters, a handwriting sample, a voice sample, etc. The player account server 222 can validate the player by comparing the login information against player information stored locally in the player account server. In some embodiments, the wagering game server 206 can detect and validate the player's login information. After the wagering game server validates the player's login information, the wagering game server can notify the wagering game machine 202. The flow continues at block 406:

At block 406, the chair motion management unit 220 determines whether player-customized chair motion preferences are available. The chair motion management unit 220 can access the player account server 222 to determine whether player-customized chair motion preferences are available for the player. By entering chair motion preferences, the player can customize motion of the gaming chairs 205. If the chair motion management unit 220 determines that the player-customized chair motion preferences are available, the flow continues at block 416. Otherwise, the flow continues at block 408.

At block 408, the chair motion management unit 220 prompts the player to enter chair motion preferences. For example, the chair motion management unit 220 can direct the wagering game machine 202 to present a prompt for configuring the chair motion preferences. The player can customize the chair motion preferences by filling out a questionnaire on the wagering game machine 202, selecting chair motion preferences from a drop down menu, clicking on check boxes, or other GUI objects, etc. For example, the player can indicate that gaming chair 205 should rock from left to right to indicate a losing wagering game event (e.g., loss of money, position on a ranking board, etc.) and vibrate to indicate a winning wagering game event (e.g., winning money, achieving a higher rank, etc.). As another example, the player may indicate the gaming chair 205 should vibrate to indicate a win in poker, while the height of the gaming chair should be increased to indicate a win in a fishing-themed slots game. The player can specify that the chair motion management unit 220 should use a rocking chair motion to indicate losses and a rotational chair motion to indicate wins.

In addition to customizing chair motions for wagering game events, the player can also customize chair motion characteristics such as, an intensity of chair motion, a frequency of chair motion, a time interval for which the chair should be in motion, a maximum elevation of the gaming chair, a default elevation of the gaming chair, a force of the chair motion, etc. For example, one player may indicate that chair motions should be at low intensity (e.g., a gentle rocking of the chair), while another player may indicate that chair motions should be at maximum intensity (e.g., high impact, high force chair motions). As another example, the player may indicate that the frequency of the chair motions should not exceed 20 Hz. As yet another example, the player may indicate that the chair should be in motion for no more than 10 seconds. The players may also have an option of customizing the motion characteristics for each wagering game event. For example, the player may indicate that the gaming chair 205 should vibrate for 5 seconds with low intensity, at a frequency of 10 Hz when the player wins a poker game. The player may also indicate that the gaming chair 205 should vibrate for 30 seconds with high intensity, at a frequency of 20 Hz when the player wins a progressive jackpot. The player may also have an option of disabling motion of the gaming chair 205. Alternately, the player may choose not to customize motion of the gaming chair 205.

In some embodiments, the chair motion management unit 220 may present a sample chair motion to enable the player make an informed choice while customizing the chair motion preferences. For example, in response to the player clicking on "sample vibrating chair motion," the chair motion management unit 220 may present a 3-second (or any suitable time interval) vibration motion of the gaming chair 205. The player may also have an option of varying the intensity, frequency, and other motion characteristics of the sample chair motion to determine which intensity level or frequency level is best suited to the player.

In some embodiments, the players are not limited to only controlling motion of their own gaming chairs. Additionally, the players may control the motion of other gaming chairs. Some embodiments enable players to select and allow others players to control motion of their gaming chairs. For example, Jim may allow Bob to control motion of Jim's chair. Bob may jolt Jim's chair (e.g., to say "hello") by pressing a button on the wagering game machine, customized remote, etc. In some embodiments, workers in a casino (e.g., a dealer at a blackjack or other wagering game table) may initiate motion of the players' gaming chairs to indicate wins and loses, encourage and boost morale, or just for fun. If the chair motion management unit 220 determines that the player entered chair motion preferences, the flow continues at block 414. Otherwise, the flow continues at block 410.

At block 410, the chair motion management unit 220 selects default chair motion preferences for the player. In some instances, the motion database 208 indicates default chair motion preferences for various wagering game types. Thus, the management unit 220 can retrieve a default chair motion preferences from the motion database 208. The default preferences can include a set of chair motion that should correspond to a set of events. The default preferences may not reflect the player's preferences and may be set by a game designer. After the chair motion management unit 220 determines the default preferences, the flow continues at block 412.

Referring back to block 408, if the player provides motion preferences, the flow continues at block 414. At block 414, after the player inputs chair motion preferences, the chair motion management unit 220 receives and stores the player-customized chair motion preferences. The chair motion management unit 220 may associate the player-customized chair motion preferences with the player's account and may store the player-customized chair motion preferences in the player account server 222. The flow continues at block 416.

At block 416, the chair motion management unit 220 determines a set of chair movements for game events. This determination can be based on the player-customized chair motion preferences and the wagering game being played. In some embodiments, the chair motion management unit 220 can access the motion database 208 for a list of chair movements specific to particular wagering games. For example, the chair motion management unit 220 may retrieve chair movements for a particular fishing-themed slots game. The list of chair movements can also indicate chair movements for events irrespective of wagering game type and theme (e.g., chair movements for wins over $20). In some embodiments, the chair motion management unit 220 can first determine a set of movements from information in the motion database 208, and then modify the set of motions in accordance with the player-customized chair motion preferences. For example, the set of chair movements may indicate that the player's gaming chair 204 should pitch (i.e., tilt with forward and backward motion) with a high intensity for 15 seconds. However, player-customized chair motion preferences may indicate that chair motions should always be at low intensity and for a maximum of 5 seconds. The chair motion management unit 220 can accordingly modify the set of chair movements in accordance with the player's preferences.

In some embodiments, the set of gaming chair movements can include movements to enhance the player's anticipation of a wagering game event. For example, during a slot game's reel spin, the chair movements may call for a vibration frequency in accordance with the speed of the spinning reels. As the spinning reels slow-down, the chair motion management unit 220 can accordingly decrease the frequency of the chair's motion to increase anticipation of the result. As another example of enhancing player anticipation, the chair movements can indicate that the gaming chair 205 should vibrate with low intensity when a first symbol is presented, vibrate with a moderate intensity if a second symbol matches the first symbol, and vibrate with high intensity if three symbols match.

The set of chair movements can also call for chair movements that prompt players to perform certain actions. For example, the chair motion management unit 220 can move the gaming chair 205 to directionally orient the player toward a wagering game machine display unit. As another example, if a game is waiting for touch-screen input from a lower left corner of the screen, the chair motion management unit 220 can tilt the gaming chair 205 in that direction. The chair motion management unit 220 can also control motion of the gaming chair 205 to reinforce button touches, the player's interaction with the display unit, etc. The chair motion management unit 220 can also move the player's gaming chair 205 to make certain effects and animations, presented on the wagering game machine display unit, more effective. For example, the chair movements can elevate and move the gaming chair 205 to make reflection of lighting across mirrors in a pinball game more effective. As another example, the chair movements can indicate objects in the wagering game are moving in a strong wind or other conditions.

The flow continues at block 418.

At block 418, the chair motion management unit 220 detects a wagering game event on the wagering game machine 202. In one embodiment, the wagering game server 206 can control the wagering game on the wagering game machine 202, detect the wagering game event, and communicate the wagering game event to the chair motion management unit 220. In another embodiment, the wagering game machine 202 itself can communicate the wagering game event to the chair motion management unit 220. In another embodiment, the chair motion management unit 220 can monitor operations of the wagering game machine 202 and detect the wagering game event (e.g., the wagering game machine publishes events and the management unit 220 subscribes to and received the events). The wagering game event can indicate the player achieving specific criteria associated with the wagering game on the wagering game machine 202. For example, the wagering game event can indicate that the player won, lost, wagered a threshold amount of money, wagered a maximum allowable amount of money, etc. In some embodiments, the wagering game event can indicate anticipatory events such as the player pulling a slot machine handle to initiate spinning of slot reels, the player casting a line in a fishing game and waiting for a fish to bite, a progressive jackpot increasing by a set amount, etc. The flow continues at block 420.

At block 420, the chair motion management unit 220 controls motion of the gaming chair 205. In some embodiments, the chair motion management unit 220 directs a motion controller (e.g., see motion controller 106 in FIG. 1) to move the gaming chair 205. The gaming chair 205 can includes actuators. The chair motion management unit 220 can determine an amount of input (e.g., electric current) that should be provided to the actuators, so that the gaming chair 205 moves in accordance to player preferences, prescribed chair movements, etc. For example, the chair motion management unit 220 can indicate, in a message to the motion controller 106, that the motion controller 106 should simultaneously apply a current of 5 mA to the actuators in order to rotate the gaming chair 205. From block 412, the flow ends.

In addition to moving individual gaming chairs, the chair motion management unit 220 can synchronize motion of multiple gaming chairs or link motion of multiple gaming chairs to a common wagering game event. This concept is described in greater detail below, in to the discussion of FIG. 5.

Figure 5:
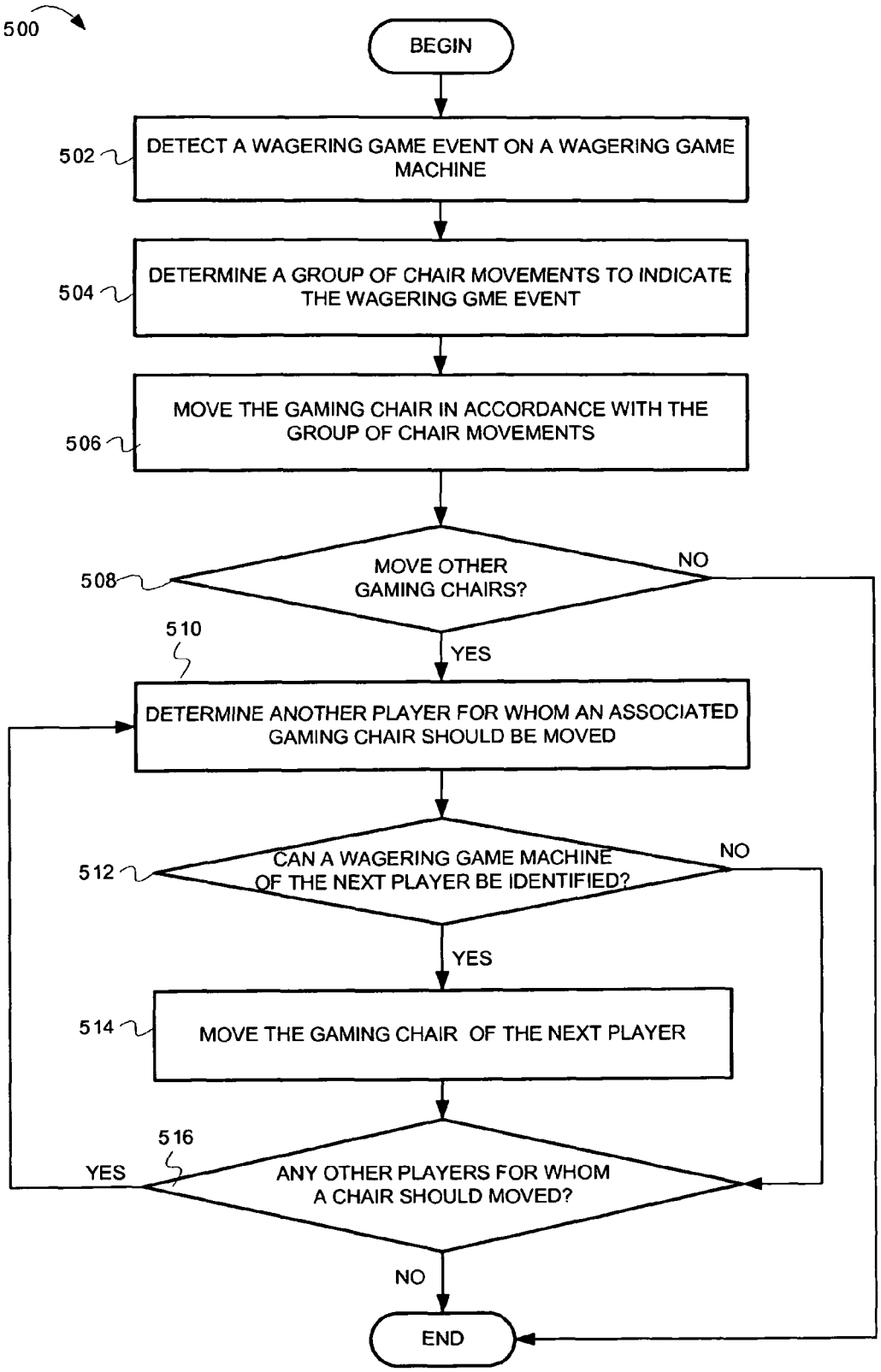
FIG. 5 is a flow diagram illustrating example operations for synchronizing motion of a plurality of gaming chairs.

FIG. 5 is a flow diagram illustrating example operations for synchronizing motion of a plurality of gaming chairs. Flow 500 will be described with reference to the conceptual diagram of FIG. 2. The flow 500 begins at block 502.

At block 502, a chair motion management unit 220 detects a wagering game event on a wagering game machine 202. For example, the chair motion management unit 220 can detect a wagering game event in response to the player winning a certain amount of money. As another example, the chair motion management unit 220 can detect an anticipatory wagering game event in response to the player casting a fishing line, as part of a fishing game. As another example, the chair motion management unit 220 can detect a wagering game event in response to a fish biting the player's fishing line in the fishing game. As another example, the chair motion management unit 220 can detect a wagering game event in response to a cannonball hitting a player's nautical vessel in a pirate-ship-themed game. The flow continues at block 504.

At block 504, the chair motion management unit 220 determines a set of chair movements to indicate the wagering game event. As described above, the chair motion management unit 220 can determine a set of chair movements based player-customized chair motion preferences, default preferences, prescribed chair movements associated with a particular wagering game, etc. The flow continues at block 506.

At block 506, the chair motion management unit 220 moves the gaming chair 205 in accordance with the group of movements determined at block 504. The chair motion management unit 220 can direct a motion controller 106 to move the gaming chair 205. For example, the chair motion management unit 220 can transmit, to a chair's motion controller, a message indicating inputs that the motion controller 106 should provide to actuators in the gaming chair 205. In another embodiment, the chair motion management unit 220 can itself provide inputs to the actuators to move the gaming chair 205. The flow continues at block 508.

At block 508, the chair motion management unit 220 determines whether to move other gaming chairs (to indicate the wagering game event). The chair motion management unit 220 can determine whether motion of the one gaming chair 205 should be synchronized with other gaming chairs. In one embodiment, the chair motion management unit 220 can access the player's chair motion preferences to determine whether to indicate the event at other gaming chairs. The player account server 222 can store the chair motion preferences and can indicate a list of wagering game events that the chair motion management unit 220 should indicate to other players. The chair motion preferences can comprise player identifiers identifying the other players that should be notified of the wagering game event. In some embodiments, the chair motion management unit 220 can determine what other players to notify on a per-game basis. The other players can be competitors, teammates, etc. The flow continues at block 510.

At block 510, the chair motion management unit 220 determines another player for whom a gaming chair should be moved. As noted, the chair motion management unit 220 can make this determination based on player account information. The flow continues at block 512.

At block 512, the chair motion management unit 220 determines whether the wagering game server can identify a wagering game machine of the next player. For example, the chair motion management unit 220 can query the wagering game server 206 about whether the next player is signed-on to a wagering game machine 202. The wagering game server 206, in turn, can search through a list of players currently playing on the wagering game machines 202. If the wagering game server determines that the next player has is playing at a wagering game machine 202, the wagering game server 206 can notify the chair motion management unit 220 and transmit a device identifier of the wagering game machine 202. If the chair motion management unit 220 can identify a wagering game machine of the next player, the flow continues at block 514. Otherwise, the flow continues at block 516.

At block 514, the chair motion management unit 220 moves the gaming chair 114 of the next player. In one embodiment, the chair motion management unit 220 can direct a motion controller to move the gaming chair 205. In some embodiments, the chair motion management unit 220 can move the gaming chair 205 to indicates the wagering game event in accordance with default chair motion preferences, player-customized chair motion preferences, prescribed motions, etc. event. In another embodiment, the chair motion management unit 220 can mirror the chair motions of the first gaming chair 205. The flow continues at block 516.

At block 516, the chair motion management unit 220 determines whether there are additional players for whom chairs should be moved. If the chair motion management unit 220 determines that there are additional players, the flow continues at block 510, where the chair motion management unit 220 identifies the next player, identifies (if possible) the wagering game machine of the next player, and moves the gaming chair for the next player. If there are no additional players for whom gaming chairs should be moved, the flow ends.

Some embodiments can move gaming chairs based on player movements. The discussion of FIG. 6 explains this concept in greater detail.

Figure 6:
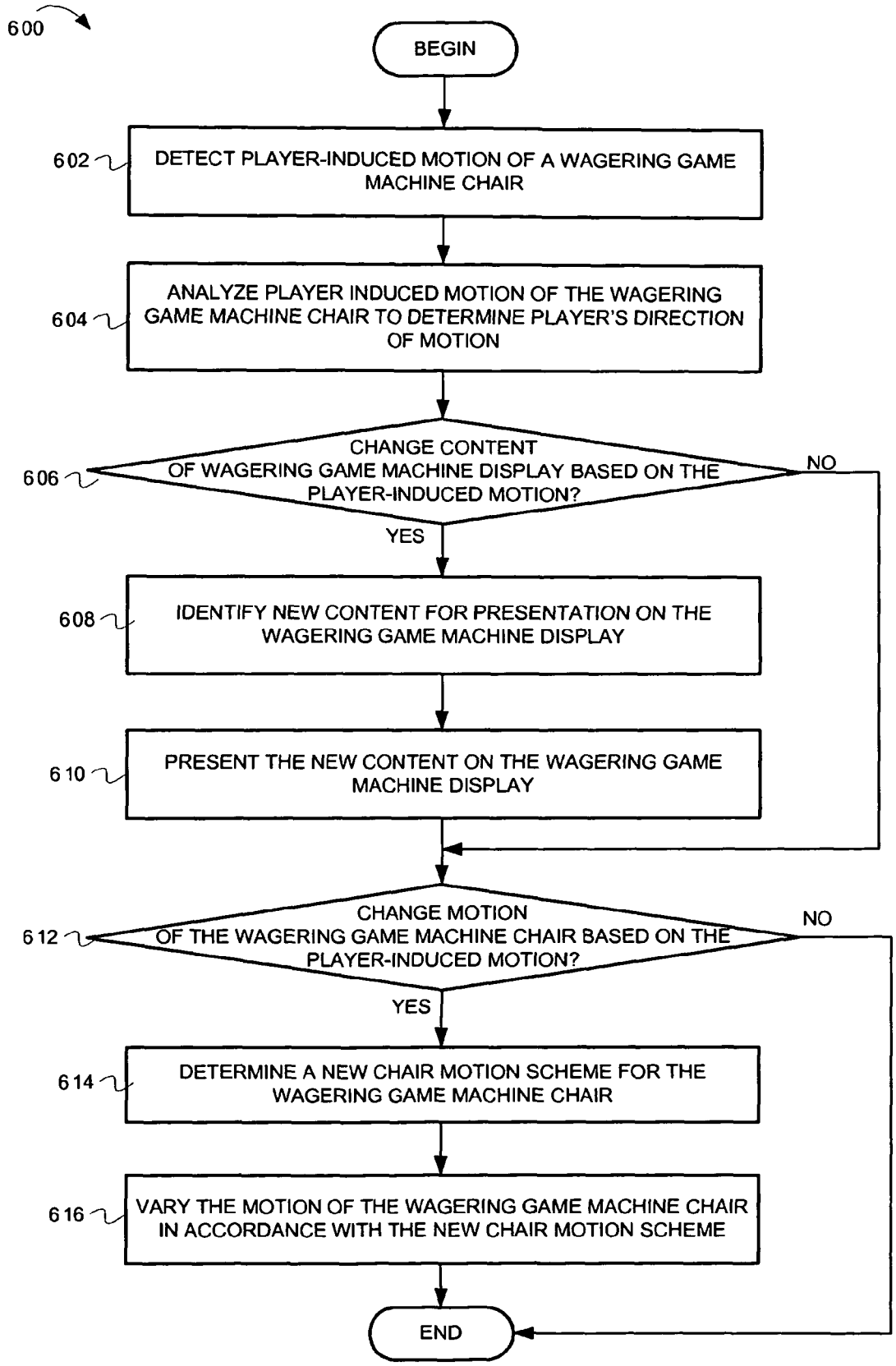
FIG. 6 is a flow diagram illustrating example operations for varying wagering game machine content and chair motion based on player-induced chair movement.

FIG. 6 is a flow diagram illustrating example operations for varying wagering game machine content and chair motion based on player-induced chair movement. Flow 600 will be described with reference to the conceptual diagram of FIG. 2. The flow 600 begins at block 602.

At block 602, a chair motion management unit 220 detects player-induced motion of a gaming chair 205. For example, the management unit 220 can detect when a player leans in the gaming chair 205 in response to content presented on the wagering game machine 202. As a more specific example, in a fishing-themed game, the management unit 220 can detect player-induced chair movement when the player leans backwards while reeling in a large fish. In one embodiment, sensors on the gaming chair 205 can detect the player-induced motion. For example, the gaming chair 205 can comprise a grid of sensors. The sensors can detect the player-induced motion (e.g., the player leaning to one side of the gaming chair 205, the player jumping on the gaming chair 205, etc.). The sensors may be pressure sensors, devices that detect tension in gaming chair's support structures, etc. In some embodiments, a motion-tracking sensor on a wagering game machine 202 may detect motion of the player. A motion controller that controls motion of the gaming chair 205 may receive output signals from the sensors and notify the chair motion management unit 220 of the player-induced motion. The flow continues at block 604.

At block 604, the chair motion management unit 220 analyses the player-induced motion of the gaming chair 205 to determine the player's direction of motion. In one embodiment, the chair motion management unit 220 may receive an indication of the sensor output from the motion controller and may interpret the sensor output. The chair motion management unit 220 may determine the player's direction of motion (e.g., whether the player is moving to the left or right), periodicity of motion, force of motion, etc. In another embodiment, the motion controller may analyze the player-induced motion and accordingly notify the chair motion management unit 220. For example, the motion controller may receive an electrical signal from the sensors, determine that the player is leaning forward, and notify the chair motion management unit 220. The flow continues at block 606.

At block 606, the wagering game server 206 determines whether to change content presented on the wagering game machine linked to the gaming chair 205. The chair motion management unit 220 may indicate to the wagering game server 206 that the player is leaning to the left. In response, the wagering game server 202 may determine whether alternate views (e.g., views consistent with the player's leftward lean) of the content are available. If the wagering game server 206 determines that content should be changed, the flow continues at block 608. Otherwise, the flow continues at block 612.

At block 608, the wagering game server 206 identifies new content for presentation on the wagering game machine display. The wagering game machine server may access a wagering game content database (not shown) and retrieve the new content based on the player's direction of motion. For example, in response to a notification, from the chair motion management unit 220, that the player is jumping in the gaming chair 205, the wagering game server 206 may move the content up and down with the same frequency as the player's motion. As another example, in response to a notification that the player is tilting to the left, the wagering game server may retrieve new content showing a left-sided view of previously presented content. In some embodiments, the wagering game server 206 can determine the new content based on content and movements of adjacent wagering game machines. The flow continues at block 610.

At block 610, the wagering game server presents the new content on the wagering game machine. For example, the wagering game server 206 may present a right-side view when, in a racecar game, the player tilts the gaming chair rightward. As another example, the wagering game server may present a top view of a game element in response to the chair motion management unit 220 indicating that the player is jumping in the gaming chair. The flow continues at block 612.

At block 612, the chair motion management unit 220 determines whether to modify the motion of the gaming chair 205 based on the player-induced motion. The chair motion management unit 220 can compare the player-induced motion with system-induced motion (if any) of the gaming chair 205, and determine whether to vary the gaming chair motion. If the player-induced motion is negligible in comparison with the system-induced motion, the chair motion management unit 220 may not vary the motion of the gaming chair 205. Alternatively, if the player-induced motion is comparable to the system-induced motion, the chair motion management unit 220 can determine new motions and move the gaming chair 205. For example, in a fishing wagering game, the player may pull on a gaming controller (e.g., a joystick) while leaning back in the gaming chair 205 to reel in a fish. The wagering game server 206 may indicate that the fish is pulling the line, with a greater force. Thus, the chair motion management unit 220 may tilt the chair forwards to indicate that the fish's force is greater than the player's force. Likewise, the chair motion management unit 220 may tilt the chair backwards if the player's force is greater. Also, the chair motion management unit 220 can also vary the motion of the gaming chair 205 to hint or create anticipation about an event, such as whether a hooked fish is large or small. If the player leans too far back, the chair motion management unit 220 may jolt the gaming chair 205, indicating the player pulled the hook out the fish's mouth. If the chair motion management unit 220 should modify the motion of the gaming chair 205, the flow continues at block 614. Otherwise, the flow ends.

At block 614, the chair motion management unit 220 determines new motions for the gaming chair 205. The chair motion management unit 220 may combine the effects of the player-induced motion and the current motion of the gaming chair 205 to determine the new chair motion. For example, if the current motion comprises vibrating the gaming chair, and the player is rocking the chair from side to side, the chair motion management unit 220 may combine the two chair motions. Thus, the new chair movements may involve rocking the gaming chair from side to side (with the same force and frequency as the player-induced motion) while simultaneously vibrating the gaming chair. The flow continues at block 616.

At block 616, the chair motion management unit 220 moves the gaming chair 205 in accordance with the new chair movements. The chair motion management unit 220 may transmit a set of instructions directing the motion controller to move the gaming chair 205. From block 616, the flow ends.

Figure 7:
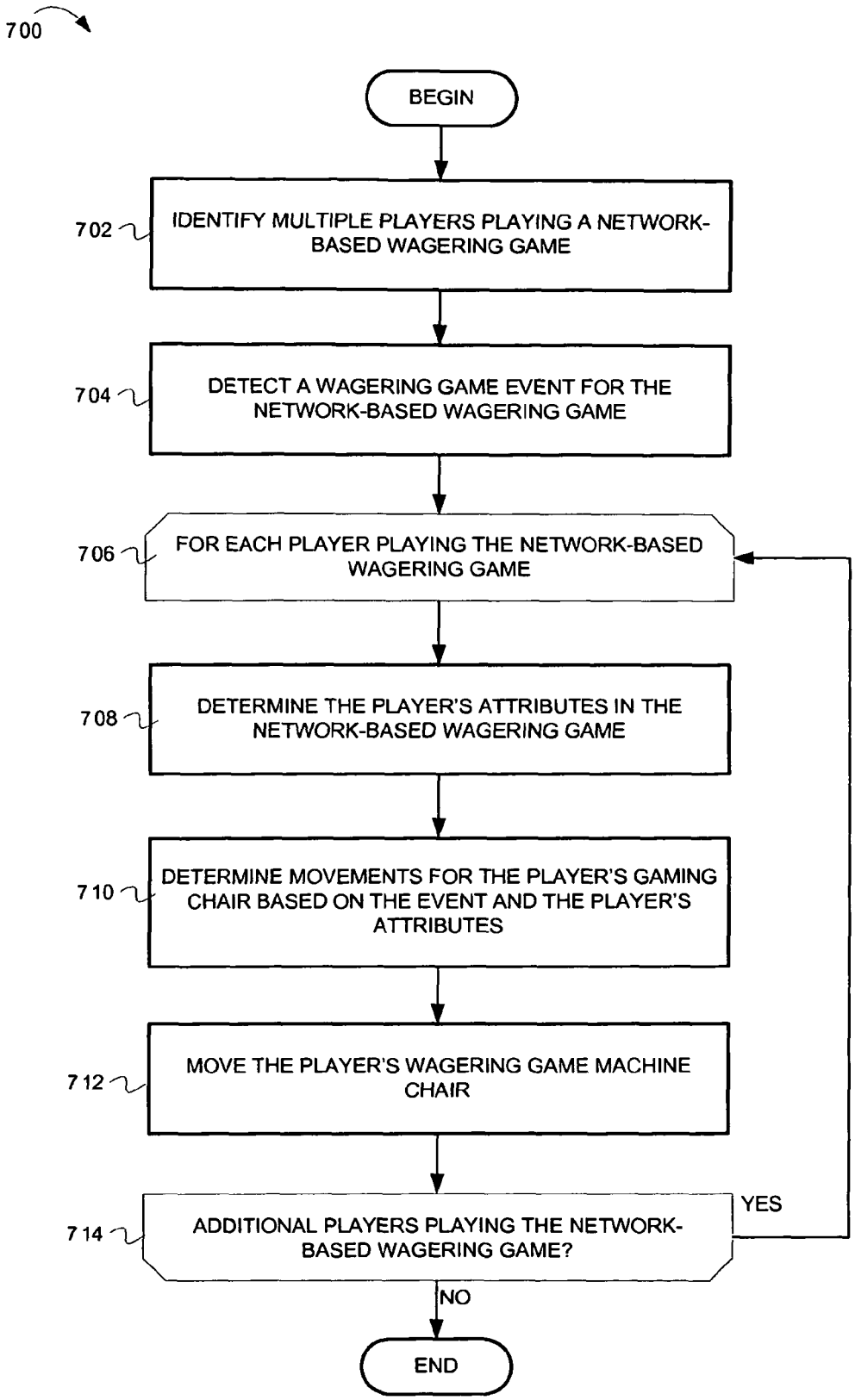
FIG. 7 is a flow diagram illustrating operations for synchronizing motion of a plurality of gaming chairs in a network-based wagering game, according to some embodiments of the invention.

FIG. 7 is a flow diagram illustrating operations for synchronizing motion of a plurality of gaming chairs in a network-based wagering game, according to some embodiments of the invention. Flow 700 will be described with reference to the conceptual diagram of FIG. 2. The flow 700 begins at block 702.

At block 702, a wagering game server 206 identifies multiple players playing a network based wagering game. The multiple players may be on a bank of adjacent wagering game machines. In another embodiment, the multiple players can be dispersed throughout the casino 212. The wagering game server 206 can notify the chair motion management unit 220 that multiple players are playing the network-based wagering game. The wagering game server 206 can also communicate player identifiers, wagering game machine identifiers, etc. In other embodiments, the chair motion management unit 220 itself may identify the players. The flow continues at block 704.

At block 704, the wagering game server 206 detects a wagering game event for the network-based wagering game. The wagering game server 206 may control part/all of the network-based wagering game (e.g., outcome of the wagering game, content of the wagering game, etc.). For example, in a pirate ship game, the wagering game server 206 may detect a wagering game event arising from a cannonball hitting the pirate ship. As another example, in a fishing game, the wagering game server 206 may detect a wagering game event arising from one of the players catching a fish. The wagering game server 206 can communicate the wagering game event to the chair motion management unit 220. The flow continues at block 706.

At block 706, the chair motion management unit 220 determines players who should be notified, via chair movement, of the wagering game event. From block 706, the chair motion management unit 220 begins a loop to perform a set of operations (described in blocks 708 through 712) for each player playing the network-based wagering game. The flow continues at block 708.

At block 708, the chair motion management unit 220 determines the player's attributes in the network based wagering game. The chair motion management unit 220 may communicate with the wagering game server 206 and request the player's attributes in the network based wagering game. The player's attributes can include the player's rank in the wagering game, a number of points accumulated by the player for the wagering game, a location of the player's avatar within the wagering game, etc. For example, for a player in a pirate ship network wagering game, the chair motion management unit 220 may determine that the player: has accumulated 700 gold coins, is in $10^{th}$ position, has a title of "cook" on the pirate ship, and is currently in the ship's kitchen. As another example, for another player in the pirate ship network wagering game, the chair motion management unit 220 may determine that the other player: has accumulated 2500 gold coins, is in $1^{st}$ position, has a title of "captain" on the pirate ship, and is currently on the ship's bridge. The flow continues at block 710.

At block 710, the chair motion management unit 220 determines movements for the player's gaming chair based, at least in part, on the wagering game event and the player's attributes. The chair motion management unit 220 can determine different chair movements depending on the player's ranking within the wagering game, number of points or other reward credits accumulated, etc. In other words, motion and sensations of the gaming chair 205 may be influenced by the player's attributes in the wagering game. In the pirate ship example, the chair motion management unit 220 may not determine movements until the player collects at least 10 gold coins. As another example, the chair motion management unit 220 may disable the gaming chair 205 until the player reaches a bonus round and plays a bonus game (e.g., against the wagering game server 206, against another player, etc.). As another example, the chair motion management unit 220 may determine a high intensity rocking motion for a player identified as the captain of the pirate ship. As another example, the chair motion management unit 220 may determine a low intensity chair motion for a player identified as a worker in the pirate ship's hold. The chair motion management unit 220 may also determine the chair movements based on the player's chair motion preferences. In some embodiments, in determining the chair motion movements, the chair motion management unit 220 may also take into consideration player-induced motion of the gaming chair 205, motion of adjacent gaming chairs, etc. For example, the chair motion management unit 220 may combine a vibrating motion (e.g., as part of a wave across a bank of gaming chairs) with a rocking motion (e.g., as a result of the wagering game event in the pirate ship wagering game). As another example, a player playing a wagering game comprising a herd of stampeding elephants may see/feel the rumbling of the stampede by sensing motion of the adjacent gaming chairs. In other embodiments, the chair motion management unit 220 may not take the motion of adjacent gaming chairs and/or ongoing motion of the gaming chair 205 into consideration while determining movements for the gaming chair.

Also, in some embodiments, the chair motion management unit 220 may move the gaming chairs to indicate status of a wagering game tournament. For example, the chair motion management unit 220 may vary gaming chair heights based on the players' scores. The player currently in first place may be at the highest elevation, while the player in last place may be at a lowest elevation. The chair motion management unit 220 may periodically determine the player's rankings in the bonus game and accordingly vary the height of the gaming chairs. As another example, the chair motion management unit 220 may elevate the winning player's gaming chair and rotate the other players' gaming chairs so the other players see the winner. Similarly, the chair motion management unit 220 may elevate a player after an event, and rotate the player's friends, so they can see the player. The flow continues at block 712.

At block 712, the chair motion management unit 220 moves the player's gaming chair 205 in accordance to the movements determined at block 710. The flow continues at block 714.

At block 714, the chair motion management unit 220 determines whether there are additional players who should be notified about the wagering game event. If there are additional players, the flow loops back to block 706 where the chair motion management unit 220 identifies the next player and performs loop operations (blocks 708-712) for the next player. It should also be noted that, in some embodiments, the chair motion management unit 220 might vary the motion of the gaming chairs simultaneously. The loop and the flow 700 ends after the chair motion management unit 220 has notified all players of the wagering game event.

Figure 8:
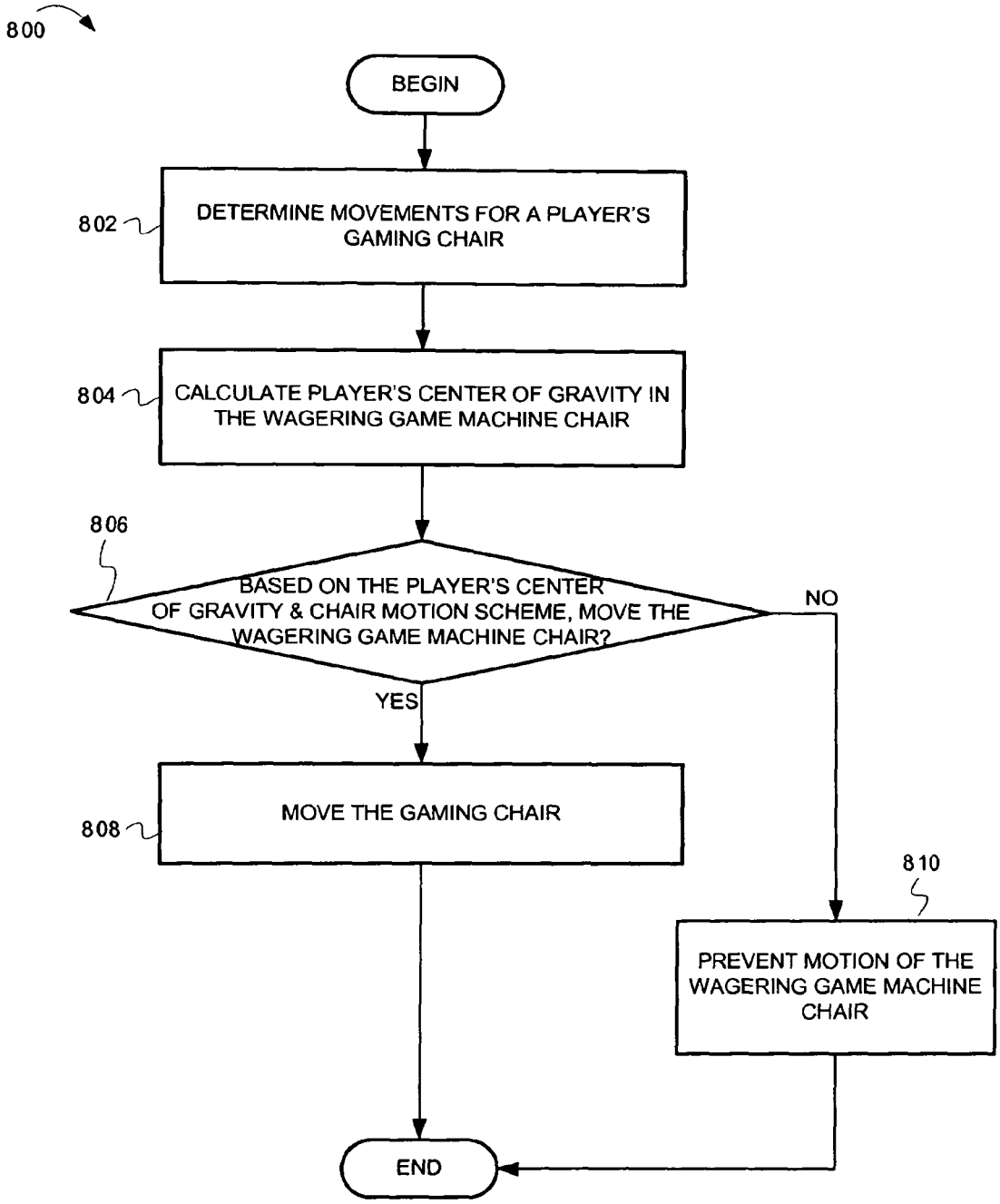
FIG. 8 is a flow diagram illustrating operations for determining chair movements based on a player's center of gravity in a gaming chair.

FIG. 8 is a flow diagram illustrating operations for determining chair movements based on a player's center of gravity in a gaming chair. Flow 800 will be described with reference to the conceptual diagram of FIG. 2. The flow 800 begins at block 802.

At block 802, a chair motion management unit 220 movements for a player's gaming chair 205. The movements can include a vibration motion, a pitch motion, a roll motion, a heave motion, a tilt motion, a rotational motion, a linear motion, or a combination of these chair motions. The chair motion management unit 220 may determine the movements in response to a wagering game event (e.g., a player winning a threshold amount of money, a fish biting a player's fishing line in a fishing game), an anticipatory event (e.g., a cumulative jackpot increasing, a cannonball moving towards a ship in a pirate ship wagering game), etc. The chair motion management unit 220 may determine the chair movements to increase excitement and/or anticipation. For example, the chair motion management unit 220 may initiate chair motions for a group of randomly selected gaming chairs, create "a wave" by successively initiating chair motions in adjacent gaming chairs, etc. The chair motion management unit 220 may also determine the chair movements based on the player's chair motion preferences, motion of adjacent gaming chairs, the player's movements, prescribed movements in the motion database, etc. The flow continues at block 804.

At block 804, the chair motion management unit 220 calculates the player's center of gravity in the gaming chair 205. In some embodiments, the chair motion management unit 220 may determine the player's center of gravity while requesting the player's motion preferences. The chair motion management unit 220 may prompt the payer to sit normally in the gaming chair 205, as if playing the wagering game. In turn, the management unit 220 can determine the player's center of gravity. In some embodiments, the chair motion management unit 220 may periodically recalculate the player's center of gravity The chair motion management unit 220 may calculate the player's center of gravity based on outputs from sensors (e.g., pressure sensors) in the gaming chair 205. The chair motion management unit 220 may calculate the player's center of gravity relative to the gaming chair's center of gravity and/or boundaries of the gaming chair 205. For example, the chair motion management unit 220 may determine that the player's center of gravity coincides with the gaming chair's center of gravity. As another example, the chair motion management unit 220 may determine that the player's center of gravity is one inch away from the front edge of the gaming chair 205. The flow continues at block 806.

At block 806, the chair motion management unit 220 determines, based on the player's center of gravity and the chair movements determined at block 802, whether to move the gaming chair 205. For example, based on the player's center of gravity, the chair motion management unit 220 may determine whether the chair motion may throw the player out of the gaming chair 205. In some embodiments, the chair motion management unit 220 may also take the player's weight into account while determining whether to move the gaming chair 205. The chair motion management unit 220 may access a set of rules to determine whether to initiate the chair motion. The set of rules can indicate that the chair motion management unit 220 should not initiate a high intensity/high force chair motion for players weighing less than 100 lbs. As another example, the set of rules may indicate that the chair motion management unit 220 should initiate the chair motion if the player's center of gravity coincides with the gaming chair's center of gravity. If the chair motion management unit 220 should move the gaming chair, the flow continues at block 808. Otherwise, the flow continues at block 810.

At block 808, the chair motion management unit 220 controls motion of the gaming chair 205 in accordance with the movements determined at block 802. The chair motion management unit 220 may direct a motion controller 106 to control movements of the gaming chair 205. From block 808, the flow ends.

At block 810, the chair motion management unit 220 prevents motion of the gaming chair 205. The chair motion management unit 220 may prevent the motion of the gaming chair 205 in response to determining chair movements may adversely affect the player (e.g., be unsafe or cause physical harm to the player). For example, the chair motion management unit 220 may disable the chair movements and prevent the motion of the gaming chair 205 after determining that a player is sitting on the front edge of the gaming chair 205. The chair motion management unit 220 may prevent motion of the gaming chair 205 if the chair movements may cause the player to fall off the gaming chair. Alternately, the chair motion management unit 220 may determine new movements (e.g., lower intensity movements) that are suitable for the player.

In some embodiments, the chair motion management unit 220 may prevent or stop motion of the gaming chair in response to external triggers. For example, sensors on the sides of the gaming chair 205 may detect and notify the chair motion management unit 220 when other players in the casino are within a given distance of the gaming chair 205. The chair motion management unit 220 may stop the chair motions or reduce intensity of the chair motion to avoid injury to the other players. From block 810, the flow ends.

The chair motion management unit 220 may implement other functionality for moving the gaming chairs. In some embodiments, the sensors on the gaming chair 205 and/or on the wagering game machine 202 may detect players walking past the wagering game machine 202 when the wagering game machine 202 is not in use. The chair motion management unit 220 may initiate chair motion to entice the player to play a wagering game and experience motion of the gaming chair 205.

Also, in some embodiments, a set of gaming chairs may be placed on a common movable platform. Players on the common movable platform may or may not play the same wagering game. In addition to controlling motion of the individual gaming chairs, the chair motion management unit 220 can also control motion of the movable platform. For example, in a fishing game, the chair motion management unit 220 may move a player's gaming chair in response to the player's motion and a wagering game event (e.g., a fish biting a player's fishing line). Additionally, because the player's motion (in a boat) can create ripples in the water, the chair motion management unit 220 may also move the common movable platform to create, a sensation of ripples on the water. As another example, the chair motion management unit 220 may move the common movable platform to indicate motion of the boat in response to one of the players on the platform having caught and reeled in a large fish.

The chair motion management unit 220 may also use motion of one or more gaming chairs to create a sense of directionality of movement/events. For example, the chair motion management unit 220 may vibrate gaming chairs to the left of the player to indicate a herd of stampeding elephants arriving from the left. As another example, the chair motion management unit 220 may vibrate a set of gaming chairs behind the player to indicate something creeping up on the player.

It should also be noted that in some embodiments, the chair motion management unit 220 might initiate chair motion irrespective of wagering game events. For example, the motion controller 106 may determine that it has not initiated chair motion on the player's gaming chair 205 for a threshold interval of time. As a result, the chair motion management unit 220 can direct the motion controller 106 to move the gaming chair 205 in accordance with selected movements to boost the player's morale, keep the player alert and interested in the wagering game, etc.

Lastly, in some embodiments, the chair motion management unit 220 may interface with other components such as a wagering game machine lighting controller, a wagering game machine sound controller, etc. to synchronize motion of the gaming chair 205 with lighting and sound effects that indicate the wagering game event. In some embodiments, intensity settings for audio, motion, and lighting effects may be tied together. For example, if the player selects low intensity chair settings, the system automatically configures lighting and sound settings at a low intensity.

Example Wagering Game Machines

Figure 9:
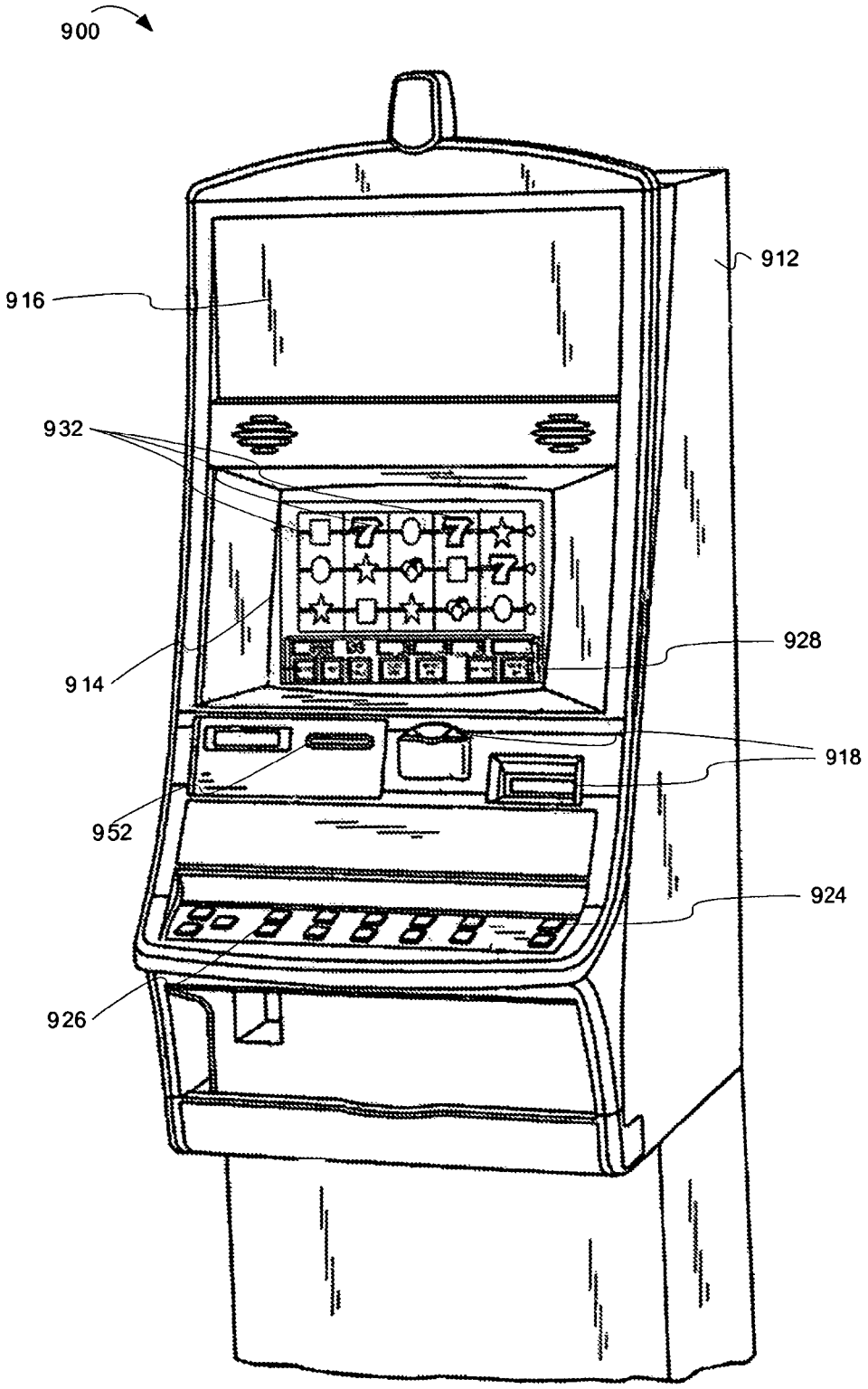
FIG. 9 is a perspective view of a wagering game machine, according to example embodiments of the invention.

FIG. 9 is a perspective view of a wagering game machine, according to example embodiments of the invention. Referring to FIG. 9, a wagering game machine 900 is used in gaming establishments, such as casinos. According to embodiments, the wagering game machine 900 can be any type of wagering game machine and can have varying structures and methods of operation. For example, the wagering game machine 900 can be an electromechanical wagering game machine configured to play mechanical slots, or it can be an electronic wagering game machine configured to play video casino games, such as blackjack, slots, keno, poker, blackjack, roulette, etc. In some embodiments, the wagering game machine 900 can be connected to a gaming chair, as described above.

The wagering game machine 900 comprises a housing 912 and includes input devices, including value input devices 918 and a player input device 924. For output, the wagering game machine 900 includes a primary display 914 for displaying information about a basic wagering game. The primary display 914 can also display information about a bonus wagering game and a progressive wagering game. The wagering game machine 900 also includes a secondary display 916 for displaying wagering game events, wagering game outcomes, and/or signage information. As noted above, the wagering game machine 900 can be connected to a gaming chair. In some embodiments, the gaming chair moves based on events for which video appears on the secondary display. Thus, some embodiments of the gaming chair can work in concert with the secondary display 916.

While some components of the wagering game machine 900 are described herein, numerous other elements can exist and can be used in any number or combination to create varying forms of the wagering game machine 900.

The value input devices 918 can take any suitable form and can be located on the front of the housing 912. The value input devices 918 can receive currency and/or credits inserted by a player. The value input devices 918 can include coin acceptors for receiving coin currency and bill acceptors for receiving paper currency. Furthermore, the value input devices 918 can include ticket readers or barcode scanners for reading information stored on vouchers, cards, or other tangible portable storage devices. The vouchers or cards can authorize access to central accounts, which can transfer money to the wagering game machine 900.

The player input device 924 comprises a plurality of push buttons on a button panel 926 for operating the wagering game machine 900. In addition, or alternatively, the player input device 924 can comprise a touch screen 928 mounted over the primary display 914 and/or secondary display 916.

The various components of the wagering game machine 900 can be connected directly to, or contained within, the housing 912. Alternatively, some of the wagering game machine's components can be located outside of the housing 912, while being communicatively coupled with the wagering game machine 900 using any suitable wired or wireless communication technology.

The operation of the basic wagering game can be displayed to the player on the primary display 914. The primary display 914 can also display a bonus game associated with the basic wagering game. The primary display 914 can include a cathode ray tube (CRT), a high resolution liquid crystal display (LCD), a plasma display, light emitting diodes (LEDs), or any other type of display suitable for use in the wagering game machine 900. Alternatively, the primary display 914 can include a number of mechanical reels to display the outcome. In FIG. 9, the wagering game machine 900 is an "upright" version in which the primary display 914 is oriented vertically relative to the player. Alternatively, the wagering game machine can be a "slant-top" version in which the primary display 914 is slanted at about a thirty-degree angle toward the player of the wagering game machine 900. In yet another embodiment, the wagering game machine 900 can exhibit any suitable form factor, such as a free-standing model, bartop model, mobile handheld model, or workstation console model.

A player begins playing a basic wagering game by making a wager via the value input device 918. The player can initiate play by using the player input device's buttons or touch screen 928. The basic game can include arranging a plurality of symbols along a payline 932, which indicates one or more outcomes of the basic game. Such outcomes can be randomly selected in response to player input. At least one of the outcomes, which can include any variation or combination of symbols, can trigger a bonus game.

In some embodiments, the wagering game machine 900 can also include an information reader 952, which can include a card reader, ticket reader, bar code scanner, RFID transceiver, or computer readable storage medium interface. In some embodiments, the information reader 952 can be used to award complimentary services, restore game assets, track player habits, etc.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

The invention claimed is:

1. A method comprising:

receiving, in a wagering game machine, access information identifying a wagering game player;

determining a motion profile of the wagering game player, wherein the motion profile is associated with a gaming chair connected to the wagering game machine, wherein the motion profile indicates movements of the gaming chair that are acceptable to the wagering game player;

determining prescribed motions for the gaming chair, wherein the prescribed motions are associated with wagering game events;

determining that one of the wagering game events occurred on the wagering game machine;

moving the gaming chair in accordance with the prescribed motions for the gaming chair and the motion profile of the wagering game player;

determining a center of gravity of the wagering game player; and reconfiguring the prescribed motions based on the center of gravity of the wagering game player.

2. A system comprising:

a wagering game machine configured to present wagering games;

a gaming chair connected to the wagering game machine, wherein the gaming chair includes actuators configured to move the gaming chair in different directions and orientations;

sensors configured to detect player-induced movements of the gaming chair;

a chair motion management unit configured to determine motions for the gaming chair based on game events and player input indicating desired motions of the gaming chair;

detect the wagering game events;

request, in response to the wagering game events, movement of the gaming chair, wherein the movement of the gaming chair is in accordance with the player input and with prescribed chair motions associated with the wagering game events; and a motion database including the prescribed chair motions, wherein the motion database is accessible to the chair motion management unit.

3. The system of claim 2 further comprising:

a motion controller connected to the gaming chair and the chair motion management unit, the motion controller configured to activate the actuators in response to the request for movement of the gaming chair.

4. The system of claim 2, wherein the game events include one or more of winning a given amount of money, losing a given amount of money, playing for a specified period of time, and winning a tournament.

5. The system of claim 2, wherein the movement of the gaming chair includes one or more of tilting the gaming chair, rotating the gaming chair, raising the gaming chair, and lowering the gaming chair.

6. The system of claim 2, wherein the chair motion management unit is further configured to determine, based on information detected by the sensors, a center of gravity of a player sitting in the gaming chair; and modify the prescribed chair motions based on the center of gravity of the player.

7. A tangible machine-readable medium including instructions, which when executed by a machine, cause the machine to perform operations comprising:

presenting a wagering game on a wagering game machine, wherein a gaming chair is connected to the wagering game machine;

determining a group of motions for the gaming chair based on player input and prescribed motions associated game events;

calculating a center of gravity of a wagering game player in the gaming chair;

comparing the center of gravity of the player with a center of gravity of the gaming chair and boundaries of the gaming chair;

determining that the motions for the gaming chair are unsafe for the wagering game player based on the comparing of the center of gravity of the player with the center of gravity of the gaming chair and the boundaries of the gaming chair;

altering the group of motions to include motions that are safe for the wagering game player; and causing the gaming chair to move according to the motions that are safe for the wagering game player.

8. The tangible machine-readable medium of claim 7, wherein the player input indicates motions for the gaming chair that are preferable to the wagering game player.

9. The tangible machine-readable medium of claim 7, wherein the motions include one or more of tilting the gaming chair, rotating the gaming chair, raising the gaming chair, and lowering the gaming chair.

10. An apparatus comprising:

means for receiving, in a wagering game machine, access information identifying a wagering game player;

means for determining the wagering game player's motion profile associated with a gaming chair connected to the wagering game machine, wherein the motion profile indicates movements of the gaming chair that are acceptable to the wagering game player;

means for determining prescribed motions for the gaming chair, wherein the prescribed movements are associated with wagering game events;

means for determining that one of the wagering game events occurred on the wagering game machine;

means for moving the gaming chair in accordance with the prescribed chair movements and the wagering game player's motion profile;

means for determining a center of gravity of the wagering game player; and means for reconfiguring the prescribed motions based on the center of gravity of the wagering game player.

* * * * *